US006431906B1

(12) United States Patent
Belopolsky

(10) Patent No.: US 6,431,906 B1
(45) Date of Patent: Aug. 13, 2002

(54) MODULAR CONNECTORS WITH DETACHABLE LINE STATUS INDICATORS

(75) Inventor: Yakov Belopolsky, Harrisburg, PA (US)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 09/795,512

(22) Filed: Feb. 28, 2001

(51) Int. Cl.[7] ..... H01R 3/00
(52) U.S. Cl. ..... 439/490
(58) Field of Search ..... 439/490, 248, 439/252, 484

(56) References Cited

U.S. PATENT DOCUMENTS

| | | | | | |
|---|---|---|---|---|---|
| 4,802,860 | A | * | 2/1989 | Kikuta et al. | 439/248 |
| 4,978,317 | A | | 12/1990 | Pocrass | 439/490 |
| 5,685,737 | A | | 11/1997 | Morin et al. | 439/490 |
| 5,797,767 | A | | 8/1998 | Schell | 439/490 |
| 5,915,993 | A | | 6/1999 | Belopolsky et al. | 439/490 |
| 5,924,889 | A | | 7/1999 | Wang | 439/490 |
| 5,924,890 | A | | 7/1999 | Morin et al. | 439/490 |
| 5,957,730 | A | | 9/1999 | Wang | 439/676 |
| 5,975,943 | A | | 11/1999 | Chou et al. | 439/490 |
| 5,984,725 | A | | 11/1999 | Belopolsky et al. | 439/607 |
| 6,113,422 | A | | 9/2000 | Somerville et al. | 439/490 |
| 6,152,762 | A | * | 11/2000 | Marshall et al. | 439/490 |
| 6,174,194 | B1 | | 1/2001 | Bleicher et al. | 439/490 |
| 6,224,417 | B1 | | 5/2001 | Belopolsky et al. | 439/490 |

FOREIGN PATENT DOCUMENTS

| | | |
|---|---|---|
| EP | 0963007 A1 | 12/1999 |
| EP | 0969551 A1 | 1/2000 |

* cited by examiner

*Primary Examiner*—Brian Sircus
*Assistant Examiner*—Phuong K T Dinh
(74) *Attorney, Agent, or Firm*—Woodcock Washburn LLP

(57) ABSTRACT

A modular connector for receiving a complementary plug to effect an electrical connection therebetween is disclosed. The connector includes a housing that defines a cavity and an opening for receiving the plug. A plurality of electrical terminals are disposed within the cavity, and are adapted to make electrical contact with complementary electrical terminals of the plug upon insertion of the plug into the cavity. A status indicator is detachably coupled to the housing. The status indicator has a status display adapted to indicate a status of the connection. The status indicator includes a lead that display can be electrically connected by a lead that provides an electrical connection between the status display and a status controller that causes the status display to indicate the status of the connection.

16 Claims, 10 Drawing Sheets

300

500'

100

400'

500

MODULAR CONNECTORS WITH DETACHABLE LINE STATUS INDICATORS

FIELD OF THE INVENTION

The present invention relates to modular connectors and, more particularly, to modular connectors having detachable line status indicators.

BACKGROUND OF THE INVENTION

Modular connectors such as receptacle jack (RJ) connectors and universal serial bus (USB) connectors are well known, especially for telecommunications and data networking equipment wherein it is necessary to provide a releasable coupling of one device to another.

Modular receptacle jacks are frequently used for the interconnection of computing devices to a telephone system, as they provide a compact, cost effective, and user friendly interface. The modular jacks releasably connect four and in some cases six or more discrete lines or circuits from one device to another via a complementary plug. Single or multiple (gang) jacks are made that couple single or multiple lines to single or multiple line devices.

In some applications, it is desirable to monitor or inform a user of the electrical activity on one or more of the connector's circuits. Such activity could be the use of the line or a trouble indication, for example. This can be accomplished by mounting an indicator light, such as a light emitting diode (LED), close to or adjacent to the connector and electrically coupling the light to the circuit. An LED located separate from the connector, however, inherently results in inefficient use of production labor to install the separate devices, and undesirably increases the necessary circuit space. For these reasons, modular connectors having integrated status indicators have previously been developed.

For example, U.S. Pat. No. 4,978,317, entitled "Connector With Visual Indicator," issued in the name of Pocrass, discloses a connector adapted to receive a mating plug therein that has a visual indicator positioned within the front wall and, thus, formed integrally with the housing to provide a visual verification of the status of the electrical connection. As the visual indicator is formed integrally with the housing, however, it is not possible to change the indicator light should it need replacing.

This problem has been addressed by U.S. Pat. Nos. 4,379,606 and 4,397,513, both entitled "Cartridge Holder and Connector System," issued in the names of Clark et al. The Clark patents disclose a cartridge holder that is adaptable to receive different cartridge configurations through a removable front plate keyed to the specific cartridge configuration. The front plate is detachably secured to the housing so that by replacing the front plate, the housing is adapted to receive different cartridge configurations. Although the front plate includes apertures to view the LEDs, the LEDs are retained in proper position by the cartridge housing. The cartridge housing in turn, is then secured to the circuit board. Thus, the Clark patents disclose devices that require removing the holder or housing from the printed circuit or mounting board in order to change or replace the LEDs.

U.S. Pat. No. 5,797,767, entitled "Indicator Light Modular Jack," issued May 31, 1996 in the name of Schell, discloses a multiple modular jack with a readily removable front panel and removable indicator lights. Although the connector of Schell has been an improvement over prior connectors, the devices disclosed therein nevertheless require the removal of the front panel to access the LEDs.

In view of the above, it is thus an object of the present invention to provide a modular connector of a type commonly used in telecommunications and data networking equipment, such as an RJ connector or a USB connector, with a detachable status indicator, such as an LED, that indicates a status of the connection, such as electrical activity on one or more of the connector's circuits.

SUMMARY OF THE INVENTION

A modular connector according to the present invention includes a housing and a status indicator that is detachably connected thereto. The housing defines a cavity, and has a front face with an opening for receiving a complementary plug. A plurality of electrical terminals are disposed within the cavity, and are adapted to make electrical contact with complementary electrical terminals of the plug upon insertion of the plug into the cavity.

The status indicator includes one or more status displays, such as light emitting diodes, for example. The status displays indicate a status of the connection between the plug and the connector, and can be coupled to a status controller by respective pairs of electrically conductive leads. The leads can be generally straight leads or springs leads, for example, and can include optional lead stabilization portions. The leads can have mounting portions that are adapted for surface mounting or for through mounting. Thus, the connector can be adapted to be mounted to a substrate on which the status controller resides.

The status controller continually senses the status of the connection between the connector and the plug, and provides electrical signals representative of the connection status to the status displays via the connecting leads. The electrical signals from the status controller cause the status displays to provide an indication of the status of the connection between the connector and the plug.

BRIEF DESCRIPTION OF THE DRAWINGS

The foregoing summary, as well as the following detailed description of the preferred embodiments, is better understood when read in conjunction with the appended drawings. For the purpose of illustrating the invention, there is shown in the drawings an embodiment that is presently preferred, it being understood, however, that the invention is not limited to the specific methods and instrumentalities disclosed.

DETAILED DESCRIPTION OF PREFERRED EMBODIMENTS

Figure 1:
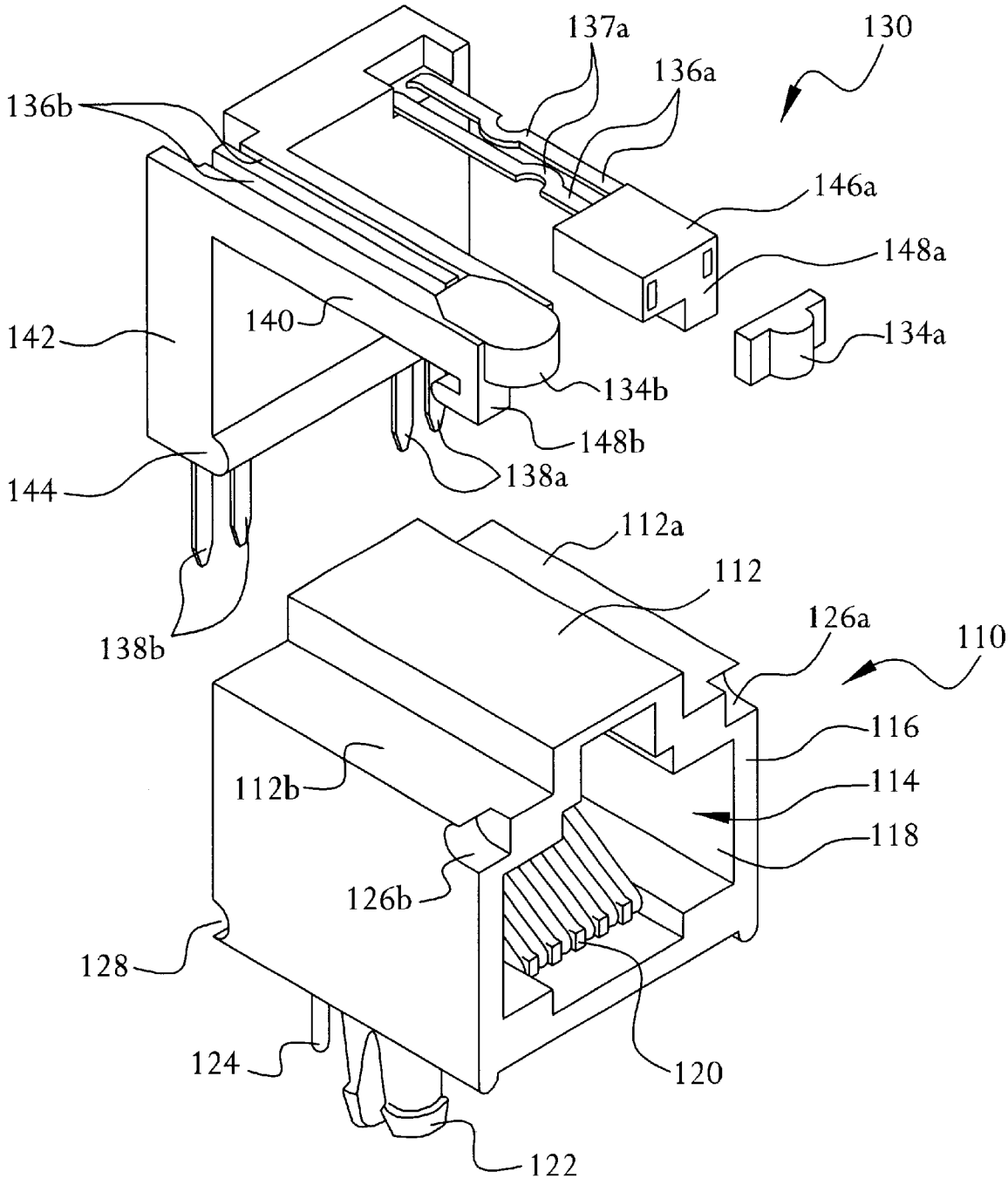
FIG. 1 is a perspective view of a preferred embodiment of a modular connector according to the present invention having both through mount (TMT) and surface mount (SMT) detachable line status indicators.

FIG. 1 depicts a modular receptacle jack (RJ) connector, generally designated 100, according to the present invention. Modular connector 100 includes a housing, generally designated 110, that defines a cavity 114 and has a front face 116. Face 116 has an opening 118 for receiving a complementary plug (not shown) to effect an electrical connection between connector 100 and the plug. Connector 100 includes a plurality of electrical terminals 120 disposed within cavity 114. Terminals 120 are adapted to make electrical contact with complementary electrical terminals of the plug (not shown) upon insertion of the plug into cavity 114. Preferably, housing 110 is molded from an electrically insulating or dielectric material, such as plastic, although any suitable material may be used.

According to the present invention, connector 100 includes a line status indicator, generally designated 130, that is detachably coupled to housing 110. Status indicator 130 can include one or more status displays 134. In the embodiment depicted in FIG. 1, status indicator 130 includes two status displays 134*a,* 134*b*. In general, status displays 134 can employ surface mount technology (SMT) or through mount technology (TMT). As shown in FIG. 1, for example, connector 100 can include one SMT status display 134*a* and one TMT status display 134*b*. Status indicator 130 is adapted to receive SMT status display 134*a* via a status display receptacle 146.

Preferably, status displays 134*a* and 134*b* are light emitting diodes (LEDs) that are electrically coupled to a status controller S (see FIG. 6A) by respective pairs of conductive leads 136*a,* 136*b*. Leads 136*a* and 136*b* can be made from an electrically conductive material, such as beryllium copper, for example. Leads 136*a* are connected to, and extend at least partially into, receptacle 146.

Similarly, connector 100 can be adapted to be mounted to a substrate, such as a printed circuit board (PCB) or printed wiring assembly (PWA) on which the status controller resides. Accordingly, connector 100 can include a mounting peg 122 that can be received into a complementary hole in the substrate. Connector 100 can also include a spacer peg 124 to support connector 100 at a distance from the surface of the substrate onto which it is mounted. Spacer peg 124 provides for cooling air flow between connector 100 and the surface of the substrate.

Preferably, status controller S continually senses the status of the connection between connector 100 and the plug, and provides electrical signals representative of the connection status to status displays 134 via leads 136. The electrical signals from the status controller cause status displays 134 to provide an indication of the status of the connection between connector 100 and the plug.

For example, in a preferred embodiment, one of the status displays can be a green LED, for example, and the other an amber LED. When the port is ready to accept a transmission, the electrical signals from the status controller can cause the green LED to light. If the port is receiving a transmission, the status controller can cause the amber LED to light. If the transmission is about to be interrupted or terminated, the status controller can cause the amber LED to flash or blink. Thus, status indicator 130 provides an indication of the status of the connection between the plug and connector 100.

In the embodiment depicted in FIG. 1, status display 134*b* is electrically coupled to status controller S by a pair of generally straight leads 136*b* (not particularly seen in FIG. 1). As shown, status indicator 130 can include a lead support 140 to support and stabilize leads 136*b* and status display 134*b*. To accomplish this, lead support 140 has a pair of channels that are sized and shaped to conform to the size and shape of leads 136*b*. Leads 136*a* do not sit in a lead support, but rather, include respective resilient portions 137. Resilient portions 137 allow status indicator 130 to clip to housing 110. Although the size, shape, and position of resilient portions 137 can be chosen as suitable for a given embodiment, resilient portions 137 are preferably semicircular, and extend toward one another so that leads 136*a* generally occupy as little space as possible.

As shown in FIG. 1, status indicator 130 can include a bracing member 142 through which leads 136*a,* 136*b* extend. Preferably, bracing member 142 is made of plastic and is integrally formed with lead support 140. Bracing member 142 is sized and shaped to conform to the size and shape of housing 110 to control the positioning of status indicator 130 when it is attached to housing 110. Terminal or mounting portions 138*a,* 138*b* of leads 136*a,* 136*b* extend beyond a bottom face of bracing member 142 for mounting connector 100 to a substrate and thereby effecting an electrical connection between status indicators 134*a,* 134*b* and status controller S on the substrate.

Preferably, bracing member 142 includes a protrusion 144 extending along a length thereof, and housing 110 includes a complementary groove 128 along a rear face thereof. Groove 128 is sized, shaped, and located to conform to the size, shape, and location of protrusion 144, so that when status indicator 130 is attached to housing 110, protrusion 144 fits snugly into groove 128. Similarly, receptacle 146 includes a protrusion 148*a,* and housing 110 includes a complementary notch 126*a* that is sized, shaped, and positioned to conform to the size, shape, and position of protrusion 148*a*. Lead support 140 includes a protrusion 148*b,* and housing 110 includes a complementary notch 126*b* that is sized, shaped, and positioned to conform to the size, shape, and position of protrusion 148*b*.

To attach status indicator 130 to housing 110, protrusion 148*a* can be set into notch 126*a,* and protrusion 148*b* set into notch 126*b*. Status indicator 130 can then be snapped into place by guiding bracing member 142 along the rear face of housing 110 until protrusion 144 snaps into groove 128 (as a result of the resilient portions 137 of leads 136 and of the plastic lead support 140 and bracing member 142). Thus, status indicator 130 is held in place when attached to housing 110.

As shown in FIG. 1, housing 110 includes a receiving face, generally designated 112, that is shaped to conform to the overall shape of status indicator 130. Preferably, for the embodiment shown in FIG. 1, receiving face 112 includes a first receiving face 112*a,* which is sized and shaped to receive leads 136*a* along with receptacle 146 and status display 134*a,* and a second receiving face 112*b,* which is sized and shaped to receive lead support 140 and status display 134*b*.

Figure 2:
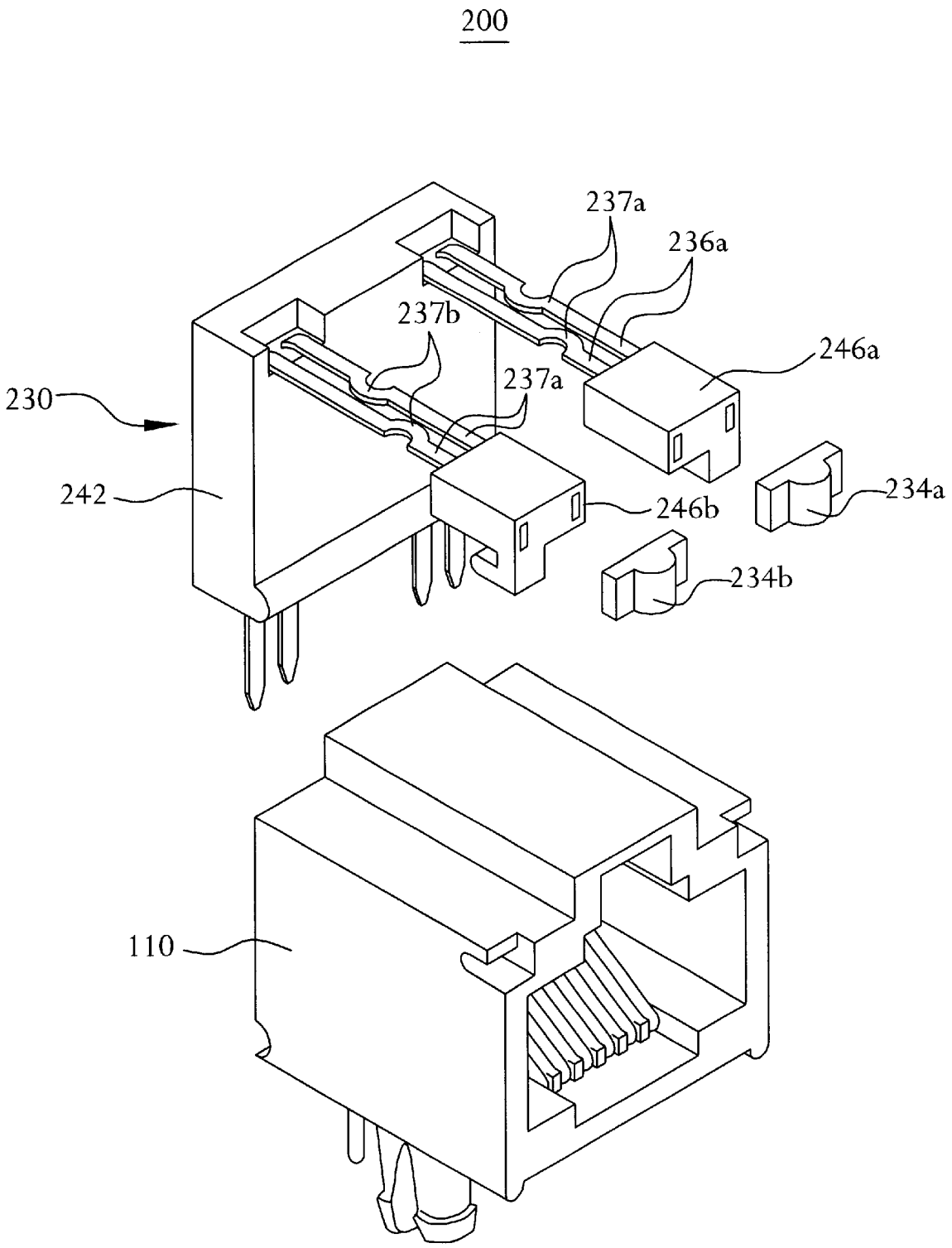
FIG. 2 is a perspective view of a preferred embodiment of a modular connector according to the present invention having two SMT detachable line status indicators.

FIG. 2 is a perspective view of a preferred embodiment of a modular connector 200 according to the present invention comprising a housing 110, which is described above in connection with FIG. 1, and a status indicator 230. As shown in FIG. 2, status indicator 230 includes two SMT status indicator displays 234*a,* 234*b*. Accordingly, connector 200 includes two receptacles 146*a* and 146*b,* which are adapted to receive status displays 134*a* and 134*b,* respectively. Also, both pairs of leads 236*a* and 236*b* include resilient portions 237*a* and 237*b,* respectively, rather than lead supports (such as depicted with respect to leads 136*b* in FIG. 1). Otherwise, as can be seen from FIG. 2, connector 200 is generally the same as connector 100 shown in FIG. 1.

Figure 3:
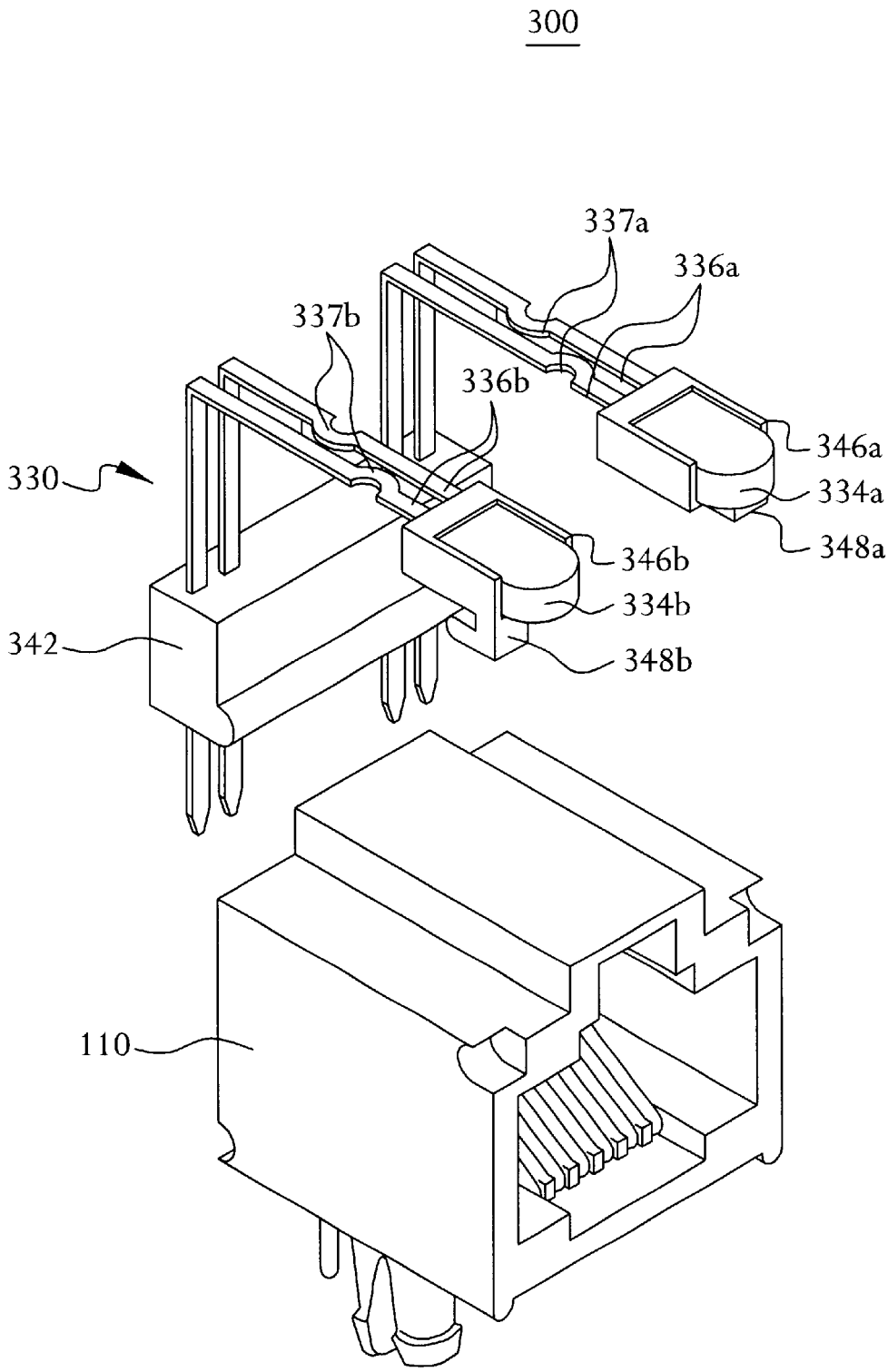
FIG. 3 is a perspective view of a preferred embodiment of a modular connector according to the present invention having two TMT detachable line status indicators.

FIG. 3 is a perspective view of a preferred embodiment of a modular connector 300 according to the present invention comprising a housing 110, which is described above in connection with FIG. 1, and a status indicator 330. As shown in FIG. 3, status indicator 330 includes two TMT status indicator displays 334*a,* 334*b*. Accordingly, connector 300 includes two receptacles 346*a,* 346*b,* which are adapted to receive respective status displays 334*a,* 334*b*. Displays 334*a,* 334*b* are connected to leads 336*a,* 336*b,* which include resilient portions 337*a,* 337*b,* respectively. Thus, either type of status display (SMT or TMT) can be connected to either type of lead (i.e., straight leads or leads having lead support regions). Connector 300 also includes a bracing member 342, which is much smaller than the bracing members depicted in FIGS. 1 and 2. Otherwise, connector 300 is generally the same as connector 200 depicted in FIG. 2.

Figure 4A:
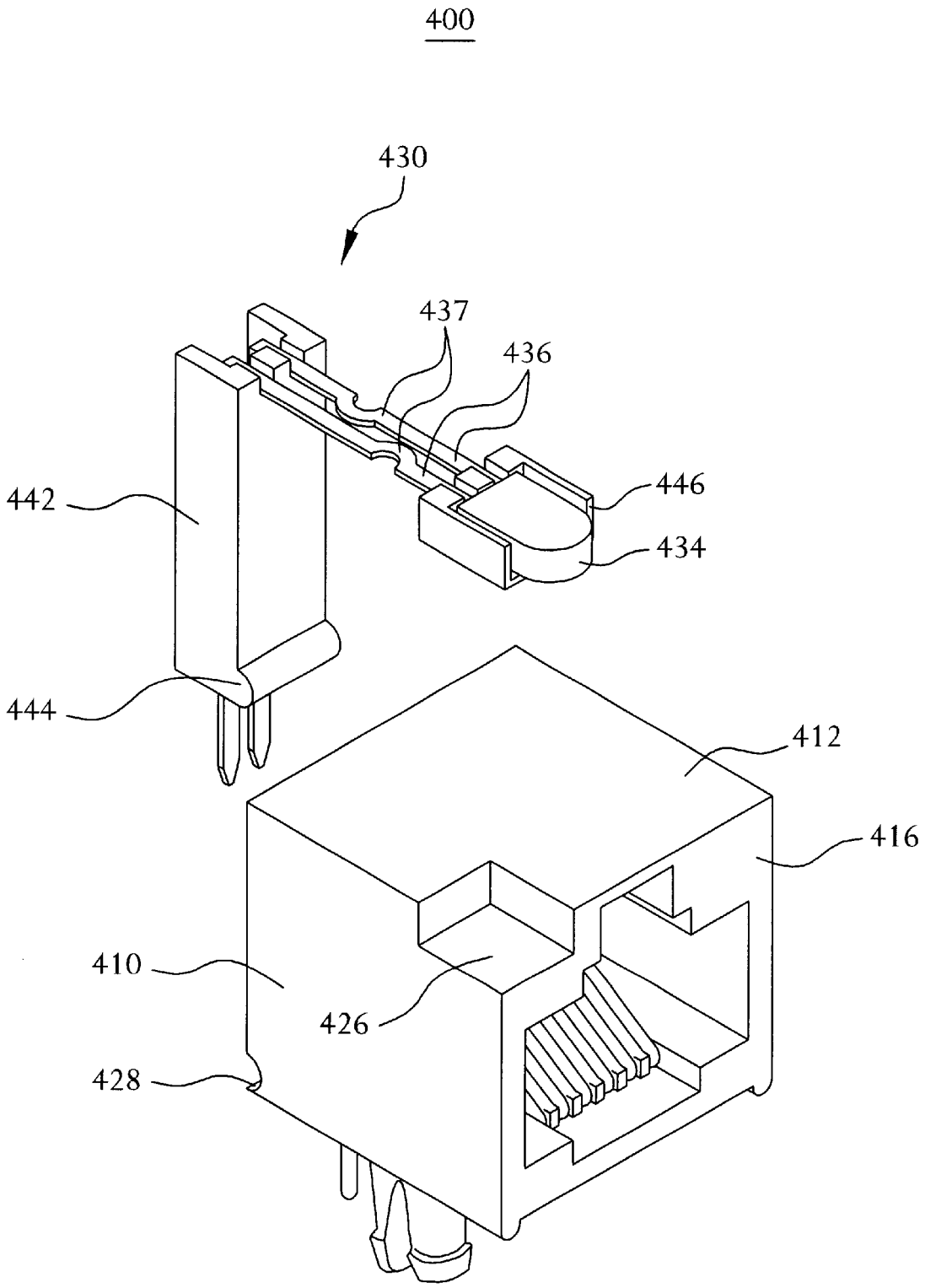
FIGS. 4A and 4B are perspective views of preferred embodiments of a modular connector according to the present invention having a single TMT detachable line status indicator.
Figure 4B:
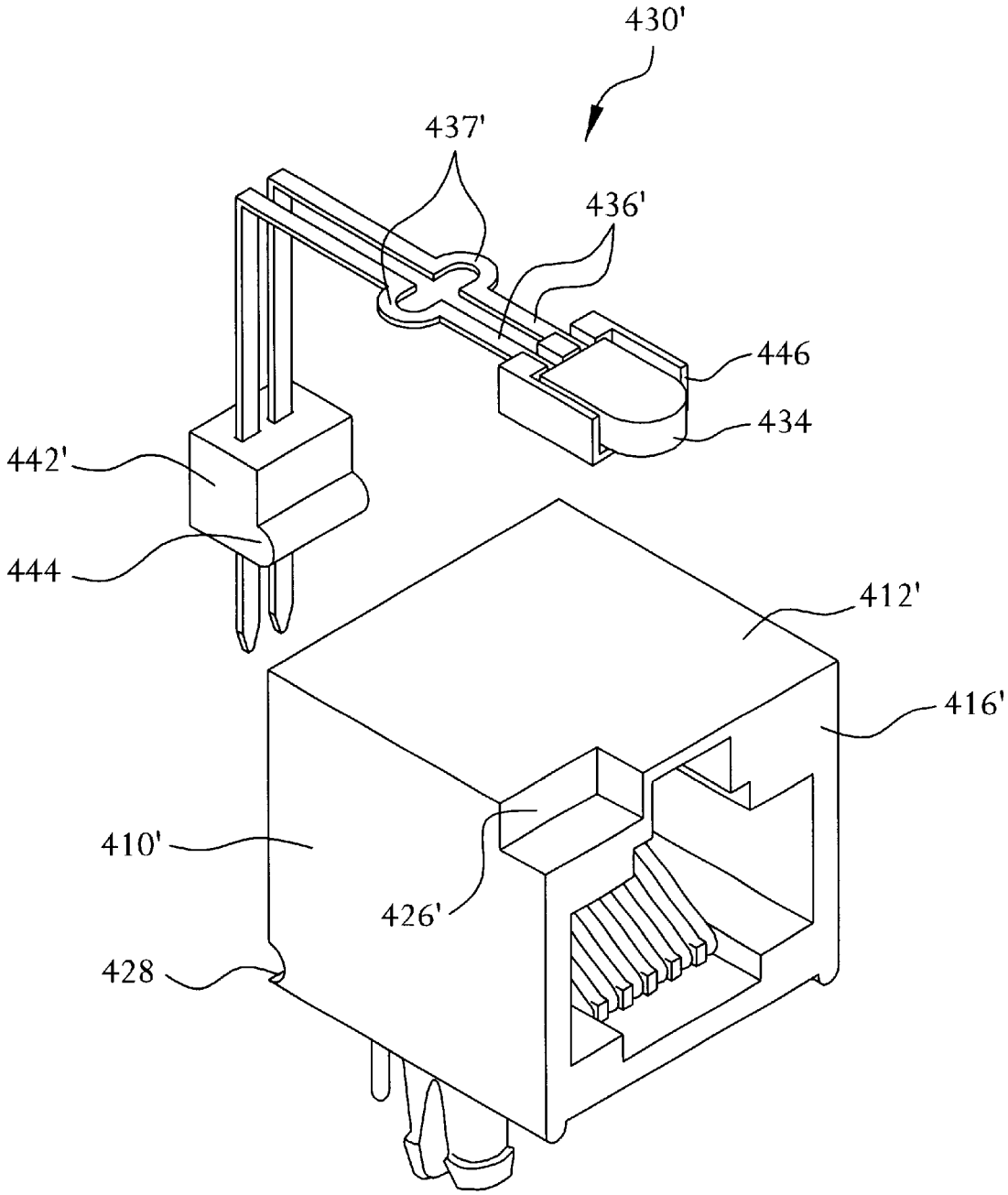

FIGS. 4A and 4B are perspective views of preferred embodiments of a modular connector according to the present invention having a single TMT status display 434. As shown, status indicator 430 can include a single TMT status display 434, and a receptacle 446, which is adapted to receive status display 434. Receiving face 412 of housing 410 can include a large notch 426, as shown in FIG. 4A, which can be sized and shaped to receive receptacle 446 so that status display 436 extends a relatively short distance beyond front face 416 of housing 410 (or is flush with or recessed behind front face 416). Alternatively, as shown in FIG. 4B, notch 426' can be made smaller (and, accordingly, leads 436' made correspondingly longer), so that status display 434 can be made to extend a relatively long distance beyond front face 416' of housing 410'. Also, a status indicator according to the invention can include either an elongated bracing member 442, as shown in FIG. 4A, or a relatively short bracing member 442', as shown in FIG. 4B. Groove 428 is sized, shaped, and located to conform to the size, shape, and location of protrusion 444, so that when status indicator 430 is attached to housing 410, protrusion 444 fits snugly into groove 428. FIG. 4B also depicts a connector wherein semicircular resilient portions 437' of leads 436' extend away from each other, rather than toward each other as do resilient portions 437 shown in FIG. 4A.

Figure 5A:
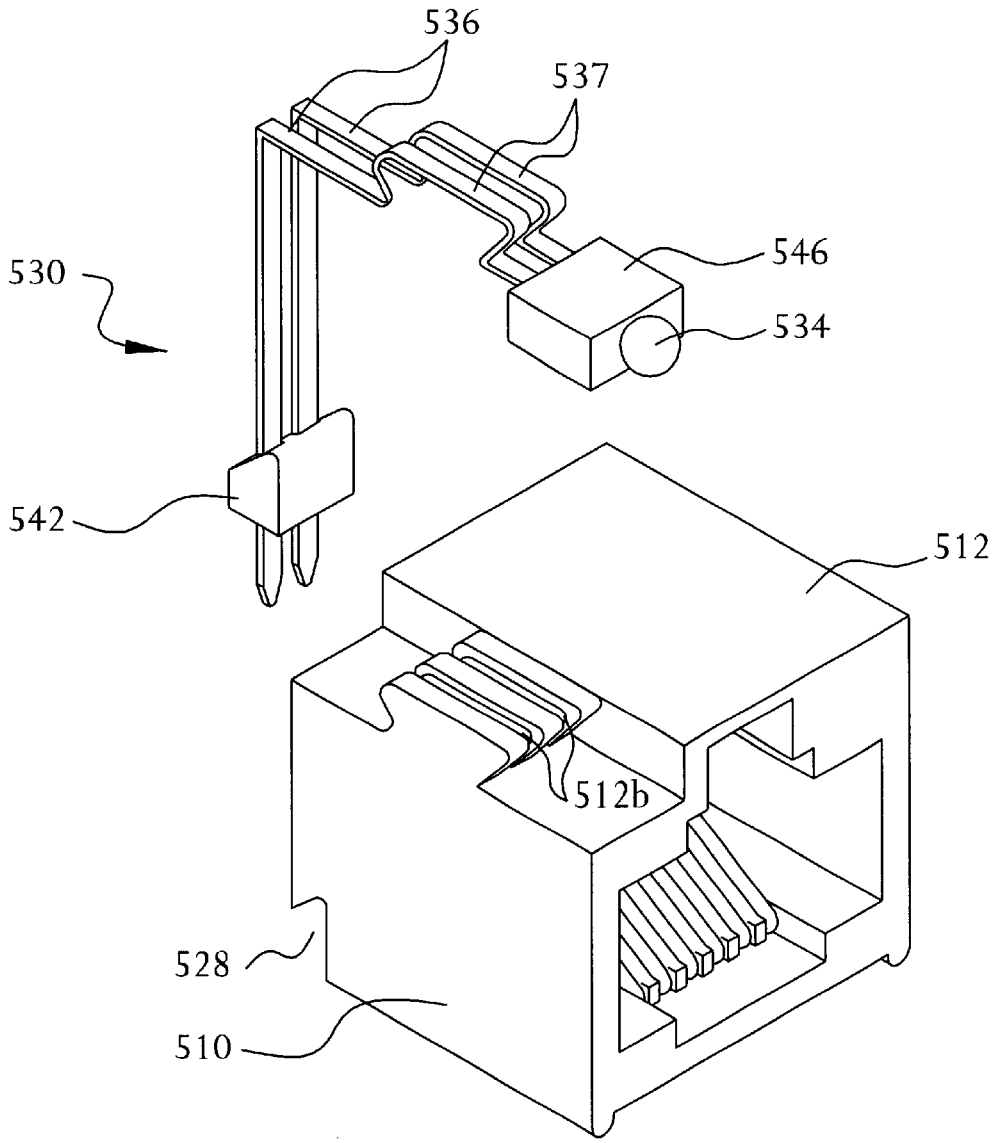
FIGS. 5A–5C are perspective views of preferred embodiments of a modular connector according to the present invention having detachable line status indicators with lead springs.

FIG. 5A is a perspective view of a preferred embodiment of a modular connector 500 according to the present invention comprising a housing 510 and a detachable line status indicator 530 having spring leads 536. Status display 534 is connected to a pair of spring leads 536, each of which has a generally "omega-shaped" resilient portion 537 as shown. Receiving face 512 of housing 510 includes a pair of complementary, omega-shaped, lead receiving portions 512*a*. To ensure that status indicator 530 will remain fixed when attached to housing 510, lead receiving portions 512*b* of receiving face 512 are slightly larger than resilient portions 537 of leads 536.

Bracing member 542 can be slid into a corresponding groove 528 in housing 510 that is sized, shaped, and located to receive bracing member 542 such that bracing member 542 fits snugly into groove 528 when status indicator 530 is attached to housing 510. After bracing member 542 is in place in groove 528, status indicator 530 can be attached to housing 510 by slightly deflecting apart the arms of resilient portions 537 of leads 536, and then snapping leads 536 into place over lead receiving portions 512*b* of receiving face 512.

Figure 5B:
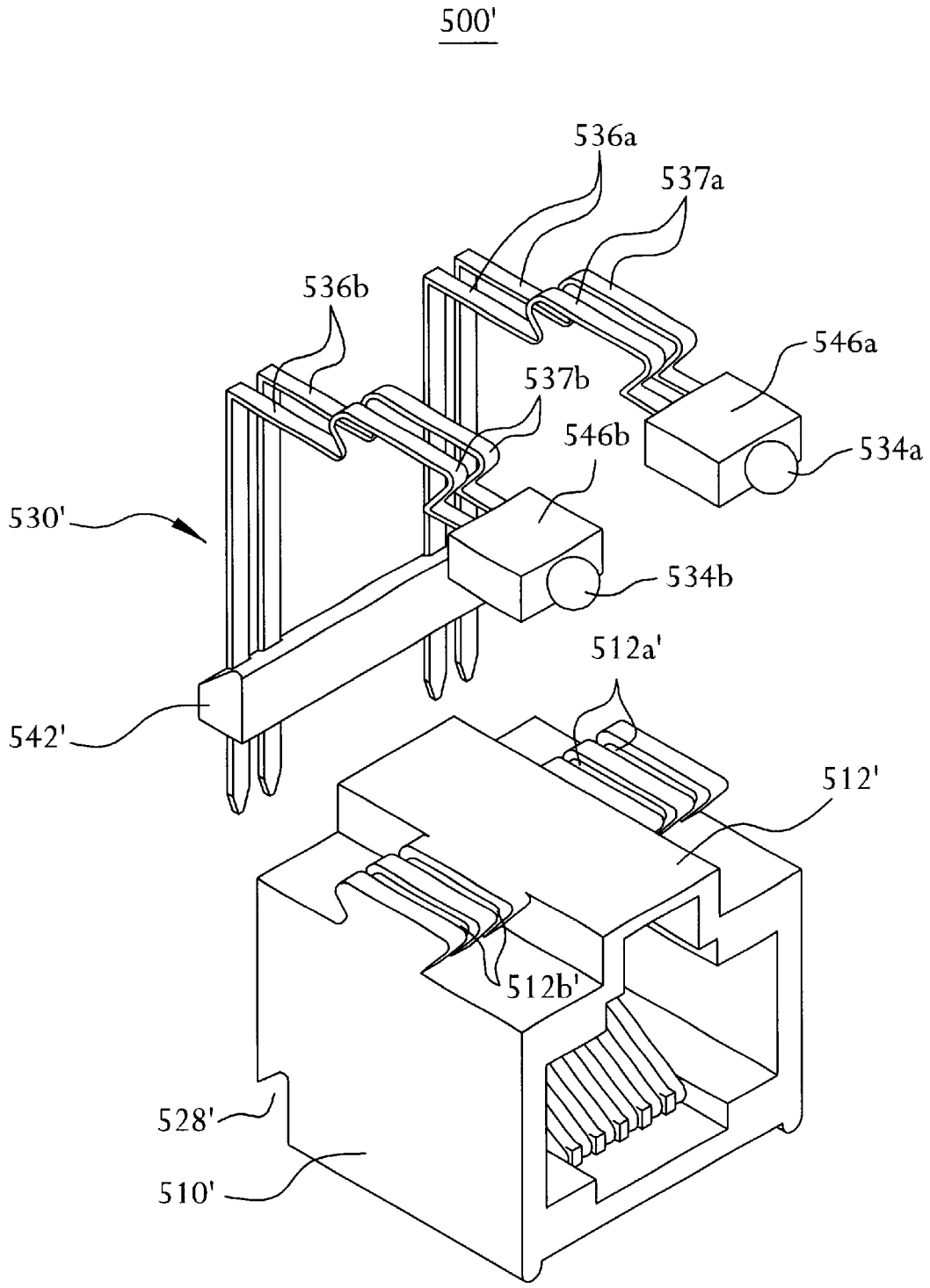

FIG. 5B depicts a connector 500' comprising a housing 510' and two status indicator displays 534*a* and 534*b*. Each status display 534*a,* 534*b* is connected to a respective pair of spring leads 536*a,* 536*b*. Accordingly, receiving face 512' of housing 510' includes two pairs of lead receiving portions 512*a*', 512*b*'. Bracing member 542' couples leads 536*a* and 536*b* to one another, and groove 528' is sized, shaped, and located to receive bracing member 542' such that bracing member 542' fits snugly into groove 528' when status indicator 530' is attached to housing 510'.

Figure 5C:
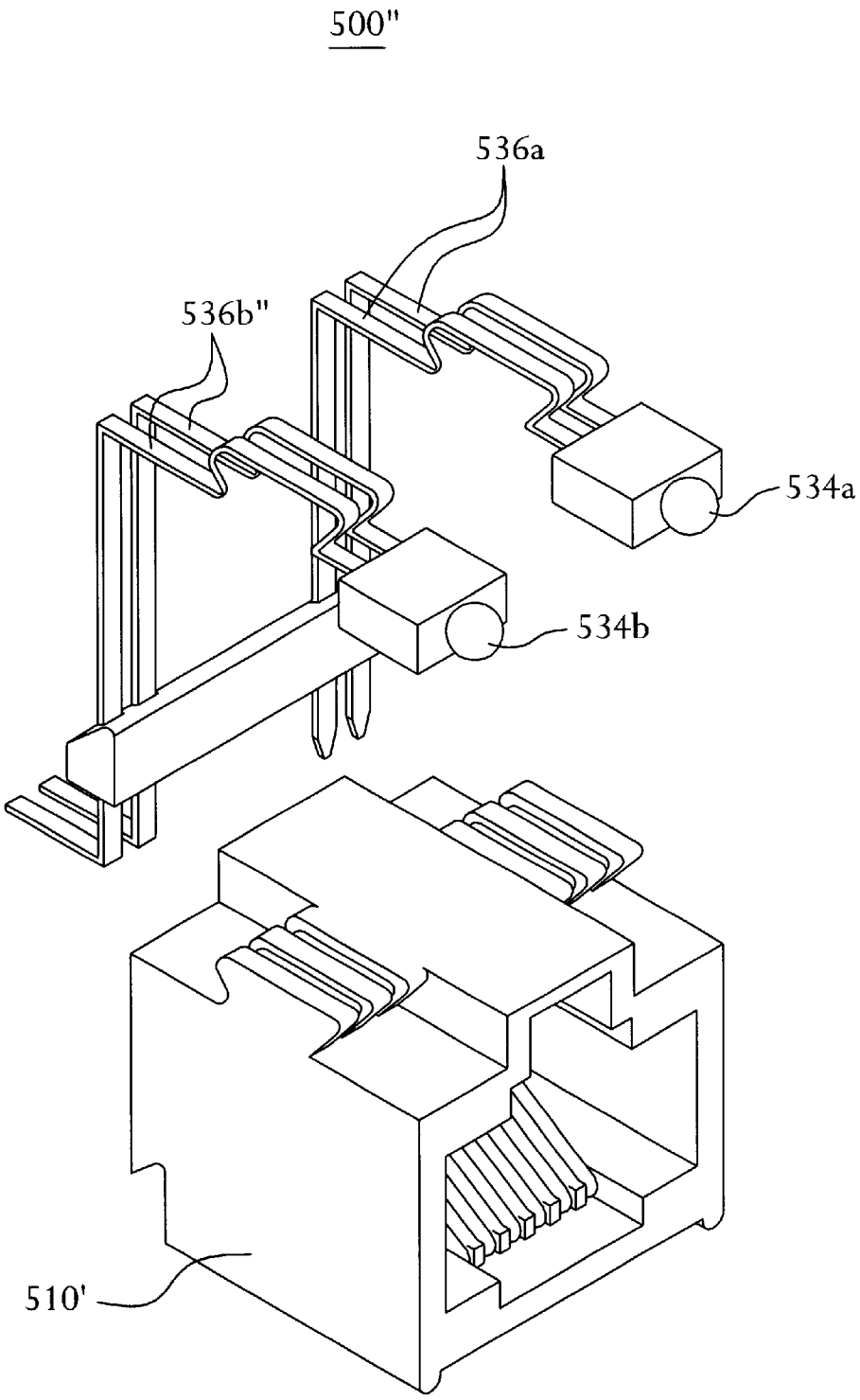

FIG. 5C depicts a connector 500", which is the same as connector 510' described in connection with FIG. 5B, except that leads 536*b*" have mounting portions that are adapted for surface mounting, while leads 536*a* have mounting portions that are adapted for through mounting. Thus, a connector according to the present invention can be surface mounted or through mounted to the substrate.

Figure 6A:
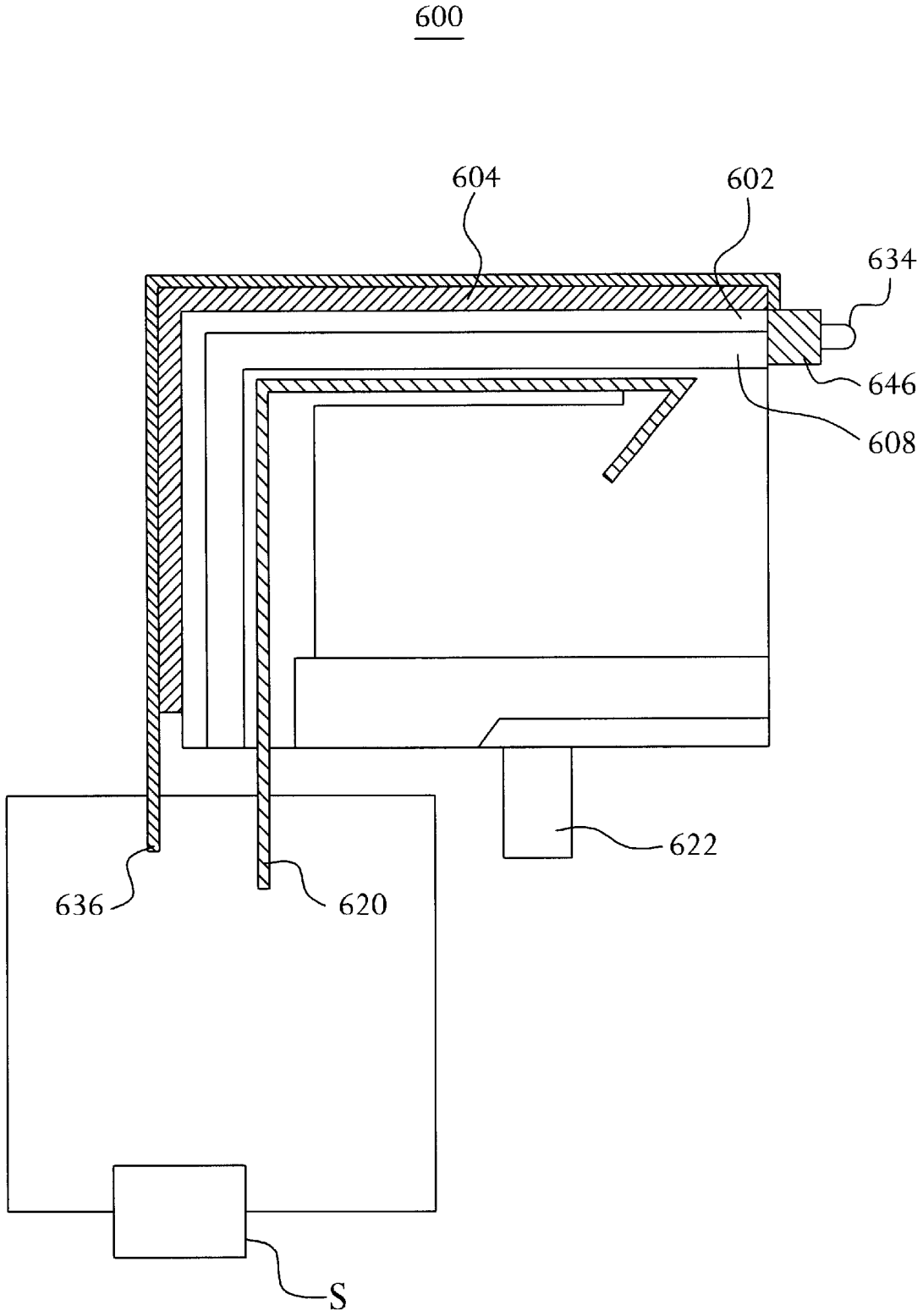
FIGS. 6A and 6B are cross-sectional and perspective views, respectively, of an assembled connector according to the present invention.
Figure 6B:
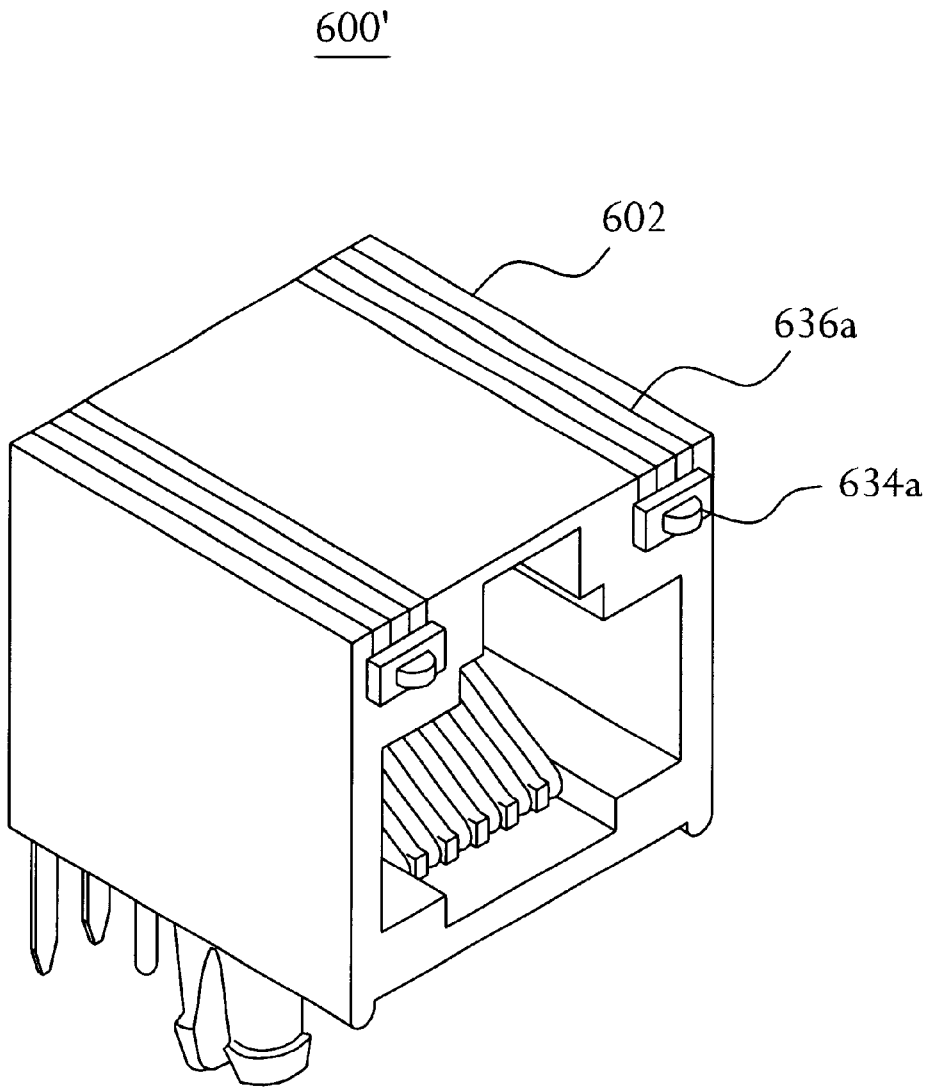

FIG. 6A is a cross-sectional view of an assembled connector 600 according to the present invention. As shown, connector 600 can include an exterior shield 602 covering the outer surfaces of housing 608. Preferably, shield 602 is made of an electrically conductive material, such as brass foil, for example, and is insulated from the status indicator by an insulating layer 604. Preferably, insulating layer 604 is formed from an electrically insulating tape. Shield 602 can be grounded and is used primarily to reduce interference from spurious electromagnetic emissions. Leads 636 can be disposed inside shield 604, as shown in FIG. 6A, or outside of shield 604, as shown in FIG. 6B. Leads 636 are electrically connected to status controller S, as are terminals 620. Thus, status controller S can determine a status of the connection between the plug (not shown) and connector 600, and provide electrical signals to cause status displays 634 to provide an indication of the connection status.

It should be noted that connector 600 depicted in FIG. 6A is a so-called "latch-down" connector, while the previously described connectors have been depicted as so-called "latch-up" connectors. That is, when using a connector such as shown in FIG. 6A, the plug latch (not shown) is turned upward (i.e., toward the top of the connector as shown in FIG. 6A) before the plug can be inserted into the receiving cavity of the connector. Similarly, with a latch-down connector, the plug must be turned downward before insertion. Thus, although the connectors described above in connection with FIGS. 1–5 are each depicted as "latch-up" connectors, it should be understood that the principles of the present invention are also applicable to "latch-down" connectors.

While the present invention has been described in connection with the preferred embodiments of the various figures, it is to be understood that other similar embodiments may be used or modifications and additions may be made to the described embodiment for performing the same function of the present invention without deviating therefrom. For example, it should be understood that, although the connectors depicted herein are each configured for the receipt of one complementary plug, the principles of the present invention as described herein are applicable to single modular connectors, as well as to multiple position modular connectors, such as so-called "gang-jacks," for example. Therefore, the present invention should not be limited to any single embodiment, but rather construed in breadth and scope in accordance with the recitation of the appended claims.

I claim:

1. A modular connector for receiving a complementary plug to effect an electrical connection therebetween, the modular connector comprising:

a housing defining a cavity and having a front face with an opening for receiving the plug;

a plurality of electrical terminals disposed within the cavity and adapted to make electrical contact with complementary electrical terminals of the plug upon insertion of the plug into the cavity; and a status indicator detachably coupled to the housing having a status display adapted to indicate a status of the connection and an electrically conductive lead having a first portion that is electrically coupled to the status display and a second portion that is connected to the first portion, the second portion of the lead for mounting the connector to a substrate, the first portion of the lead having a generally semicircular resilient portion that enables the status indicator to be detachably coupled to the connector housing.

2. The connector of claim 1, wherein the status display comprises a light emitting diode (LED).

3. The connector of claim 1, wherein the electrically conductive lead is in electrical contact with the status display.

4. The connector of claim 1, wherein the status indicator further comprises a bracing member through which the electrically conductive lead extends, the bracing member adapted to attach the status indicator to the housing.

5. The connector of claim 4, wherein the bracing member includes a protrusion extending along a length thereof, the protrusion adapted to be received into a complementary groove disposed on a face of the housing.

6. The connector of claim 1, wherein the lead includes a tail portion for surface mounting the connector to a substrate.

7. The connector of claim 1, wherein the lead includes a tail portion for through mounting the connector to a substrate.

8. The connector of claim 1, wherein the housing has a plurality of outer surfaces, and the connector further comprises an electrically conductive shield disposed to cover the outer surfaces of the housing.

9. The connector of claim 8, the connector further comprising:

an electrically insulating layer disposed between the lead and the shield.

10. A status indicator for a modular connector, the connector having a housing with an opening for receiving a complementary plug to effect an electrical connection therebetween, the status indicator comprising:

a status display for indicating a status of the electrical connection between the connector and the plug; and an electrically conductive lead having a first portion that is electrically coupled to the status display and a second portion that is connected to the first portion, the second portion of the lead for mounting the connector to a substrate, the first portion of the lead having a generally semicircular resilient portion that enables the status indicator to be detachably coupled to the housing, the lead having a terminal end adapted to electrically couple the status indicator to a status controller that provides electrical signals to cause the status display to provide an indication of the status of the electrical connection.

11. The status indicator of claim 10, further comprising:

a bracing member through which the lead extends, wherein the bracing member is adapted to control the positioning of the status indicator when the status indicator is attached to housing.

12. The status indicator of claim 10, further comprising:

a status display receptacle that is connected to the lead and adapted to receive the status display.

13. The status indicator of claim 12, wherein the display receptacle includes a protrusion adapted to fit into a complementary notch in the housing.

14. The status indicator of claim 13, further comprising:

a bracing member through which the lead extends, wherein the bracing member includes a protrusion adapted to fit into a complementary groove disposed along a face of the housing, such that the status indicator can be attached to housing by setting the display receptacle protrusion into the notch, and then guiding the bracing member along the face of the housing until the bracing member protrusion is set into the groove.

15. A status indicator for a modular connector, the connector having a housing with an opening for receiving a complementary plug to effect an electrical connection therebetween, the status indicator comprising:

a first status display;

a first pair of conductive leads that are electrically connected to the first status display;

a second status display; and a second pair of conductive leads that are electrically connected to the second status display;

wherein at least one of the conducive leads has a first portion that is electrically coupled to the respective status display and a second portion that is connected to the first portion, the second portion of the at least one lead for mounting the connector to a substrate, the first portion of the lead having a generally omega shaped resilient portion that enables the status indicator to be detachably coupled to the connector housing, and a terminal end adapted to electrically couple the status indicator to a status controller that provides electrical signals to cause the status displays to provide an indication of the status of the electrical connection.

16. The status indicator of claim 15, wherein the signals from the status controller cause the first status display to emit light of a first color, thereby providing a first connection status indication, and the second status display to emit light of a second color, thereby providing a second connection status indication.

* * * * *